US007458769B2

(12) United States Patent
Forgue et al.

(10) Patent No.: US 7,458,769 B2
(45) Date of Patent: Dec. 2, 2008

(54) DEVICE FOR DAMPING VIBRATION OF A RING FOR AXIALLY RETAINING TURBOMACHINE FAN BLADES

(75) Inventors: Jean-Bernard Forgue, Montacher-Villegardin (FR); Jack-Pierre Lauvergnat, Savigny le Temple (FR); Henry Louis Paul Nicolas Loiseau, Melun (FR); Didier Monnet, Moissy Cramayel (FR); Thierry Nitre, Yerres (FR); Patrick Jean-Louis Reghezza, Vaux le Penil (FR)

(73) Assignee: SNECMA, Paris (FR)

( * ) Notice: Subject to any disclaimer, the term of this patent is extended or adjusted under 35 U.S.C. 154(b) by 329 days.

(21) Appl. No.: 11/457,954

(22) Filed: Jul. 17, 2006

(65) Prior Publication Data

US 2007/0020089 A1 Jan. 25, 2007

(30) Foreign Application Priority Data

Jul. 21, 2005 (FR) ..... 05 07753

(51) Int. Cl.
*F01D 5/30* (2006.01)
*F04D 29/66* (2006.01)

(52) U.S. Cl. ..... 415/119; 416/220 R

(58) Field of Classification Search ..... 415/119; 416/220 R, 221
See application file for complete search history.

(56) References Cited

U.S. PATENT DOCUMENTS

| | | | | |
|---|---|---|---|---|
| 3,096,074 | A * | 7/1963 | Pratt et al. | 416/215 |
| 3,768,924 | A * | 10/1973 | Corsmeier et al. | 416/95 |
| 5,173,024 | A * | 12/1992 | Mouchel et al. | 416/220 R |
| 6,494,684 | B1 * | 12/2002 | Wagner | 416/248 |
| 6,595,755 | B2 * | 7/2003 | Brioude et al. | 416/220 R |
| 2003/0194318 | A1 | 10/2003 | Duesler et al. | |

FOREIGN PATENT DOCUMENTS

| | | |
|---|---|---|
| EP | 1 096 107 A2 | 5/2001 |
| FR | 2 803 623 | 7/2001 |

* cited by examiner

*Primary Examiner*—Igor Kershteyn
(74) *Attorney, Agent, or Firm*—Oblon, Spivak, McClelland, Maier & Neustadt, P.C.

(57) ABSTRACT

A device for damping vibration of a retention ring for axially retaining turbomachine fan blades, the blades being designed to be mounted via their roots on a rotary disk having an annular flange extending axially and provided with a plurality of radial crenellations for coming into contact with a plurality of complementary radial crenellations of a retention ring designed to be mounted around the disk flange, the device comprising an abutment element of elastomer material designed to be received axially between two adjacent crenellations of the flange and two adjacent complementary crenellations of the retention ring, and radially between the flange of the rotary disk and the retention ring, said abutment element presenting contact surfaces for coming into contact with the adjacent crenellations, with the retention ring, and with the flange of the rotary disk.

9 Claims, 4 Drawing Sheets

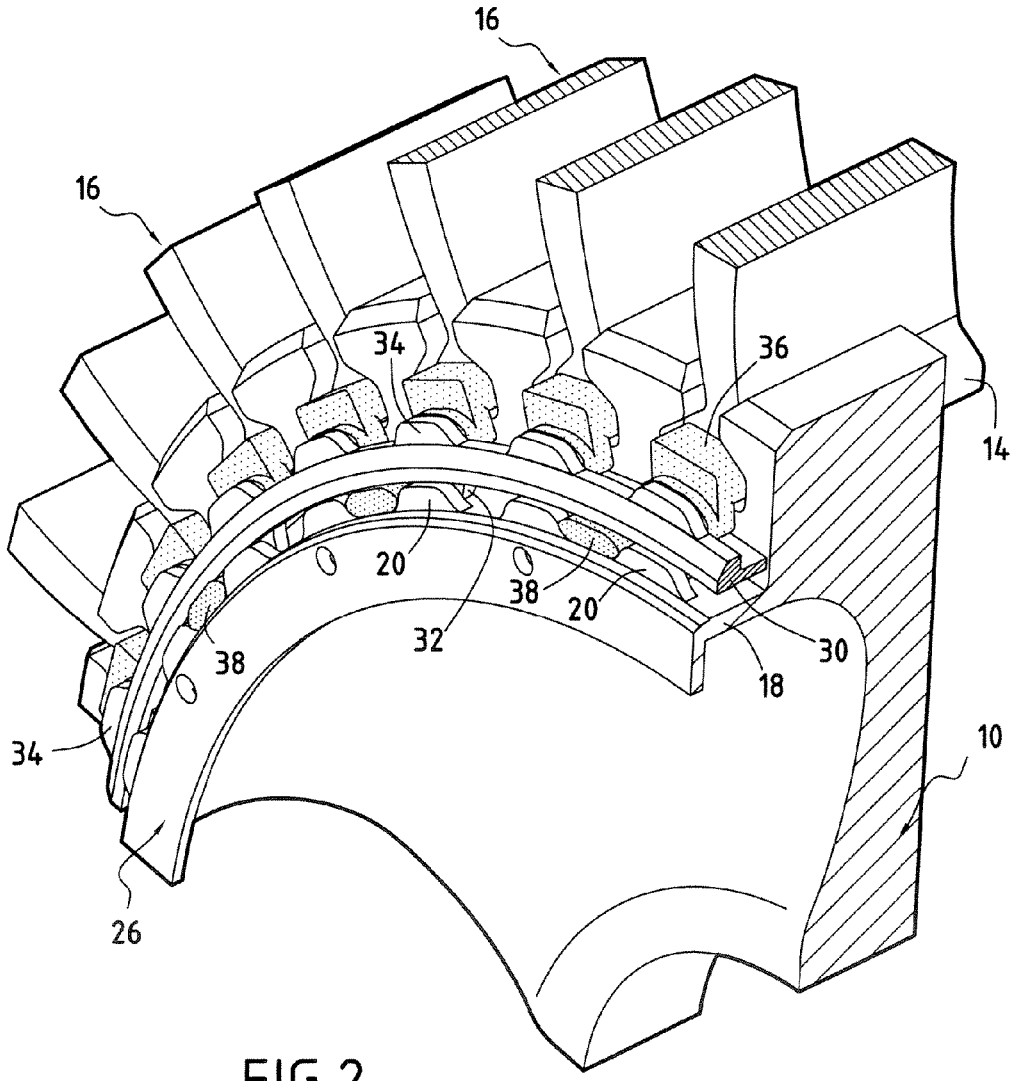
FIG.2
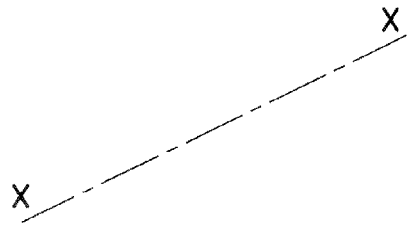

FIG.5
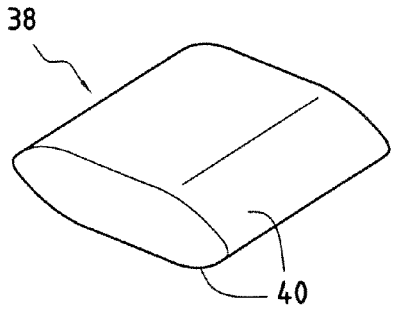
FIG.6
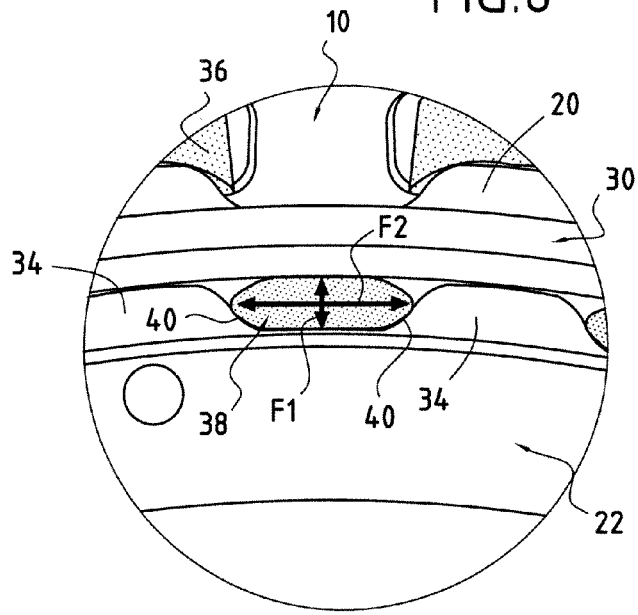
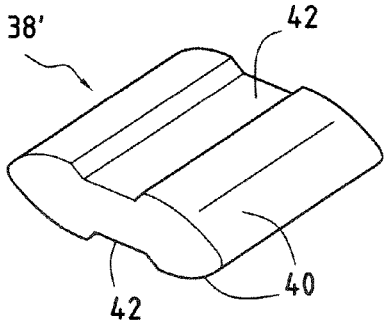
FIG.7A
FIG.7B
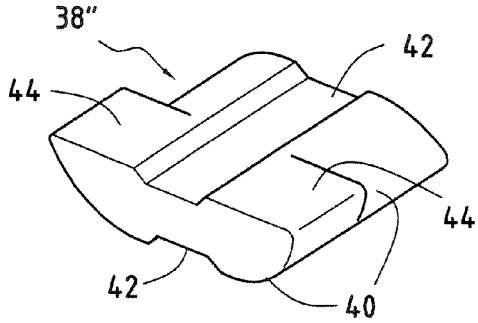

DEVICE FOR DAMPING VIBRATION OF A RING FOR AXIALLY RETAINING TURBOMACHINE FAN BLADES

BACKGROUND OF THE INVENTION

The present invention relates to the general field of mounting fan blades on a rotary disk of a turbomachine. The invention relates more particularly to a device serving to damp the vibration to which the ring for axially retaining the fan blades is subjected.

The fan of a turbomachine typically comprises a plurality of blades mounted on a rotary disk via blade roots which are received in slots in the disk. In certain technologies for mounting fan blades, a ring is also placed around an annular flange extending axially from the upstream side of the rotary disk. Such a ring is held axially against the flange via crenellations formed around the entire circumference thereof. The ring is also mounted in axial abutment against the roots of the blades so as to retain said roots axially.

In practice, that type of fan blade mounting raises numerous problems. In particular, wear is observed on the axial retention ring and on the rotary disk. The wear is mainly caused by the vibration to which the axial retention ring is subject during rotation of the disk. In particular, rotation of the disk leads to small movements of the axial retention ring, causing wear on the tops of the crenellations of the annular flange for holding the ring on the disk. In addition, during rotation of the disk, the axial retention ring tends to move tangentially around the disk flange.

OBJECT AND SUMMARY OF THE INVENTION

A main object of the present invention is thus to mitigate such drawbacks by proposing a device for damping the vibration to which the ring for axially retaining fan blades is subject.

To this end, the invention provides a device for damping vibration of an axial retention ring for retaining fan blades of a turbomachine, said fan blades being designed to be mounted via their roots on a rotary disk including an annular flange extending axially and provided with a plurality of radial crenellations for coming into contact with a plurality of complementary radial crenellations of the retention ring that is to be mounted around said flange of the disk, said device being made up of an abutment element of elastomer material that is to be received axially between two adjacent crenellations of the flange and two adjacent complementary crenellations of the retention ring, and radially between the flange of the rotary disk and the retention ring, said abutment element presenting contact surfaces for coming into contact with said adjacent crenellations, with the retention ring, and with the flange of the rotary disk.

By adding contact surfaces with the axial retention ring and the disk flange, the device of the invention serves to modify the natural modes of vibration of the retention ring. In addition, since the device is constituted by an element made of elastomer material, its surfaces that come into contact with the retention ring and the disk flange tend, under the centrifugal effect, to become pressed against the retention ring and the flange. Thus, the vibration to which the retention ring is subject is damped and any risk of wear is avoided. The use of such a damper device can also serve to block the retention ring tangentially around the disk flange.

The abutment element of the damper device may be substantially in the form of a flat rectangular block. It may also have a geometrical shape for error-avoidance purposes while it is being mounted on the disk.

Preferably, the elastomer material of the abutment element presents hardness lying in the range 50 to 90 on the Shore scale. This elastomer material is preferably a silicone, a fluorosilicone, or a fluorocarbon.

The invention also provides a ring for axially retaining the fan blades of a turbomachine, the ring including at least one of the above-specified vibration damper devices.

The invention also provides a rotary disk for a turbomachine for mounting blades of a fan, the disk including an annular flange extending axially and provided with a plurality of radial crenellations for coming into contact with a plurality of complementary radial crenellations of a retention ring for axially retaining fan blades and designed to be mounted around the flange of the disk, the disk further comprising at least two damper devices as defined above. Finally, the invention provides a turbomachine including at least one rotary disk as defined above.

BRIEF DESCRIPTION OF THE DRAWINGS

Other characteristics and advantages of the present invention appear from the following description given with reference to the accompanying drawings which show an embodiment having no limiting character. In the figures:

FIG. 2 is a view of the FIG. 1 disk when assembled;

FIG. 5 is a perspective view of the FIG. 1 vibration damper device;

FIG. 6 is an enlarged view showing a detail of FIG. 2; and

FIGS. 7A and 7B are perspective views of vibration damper devices in other embodiments of the invention.

DETAILED DESCRIPTION OF AN EMBODIMENT

Figure 1:
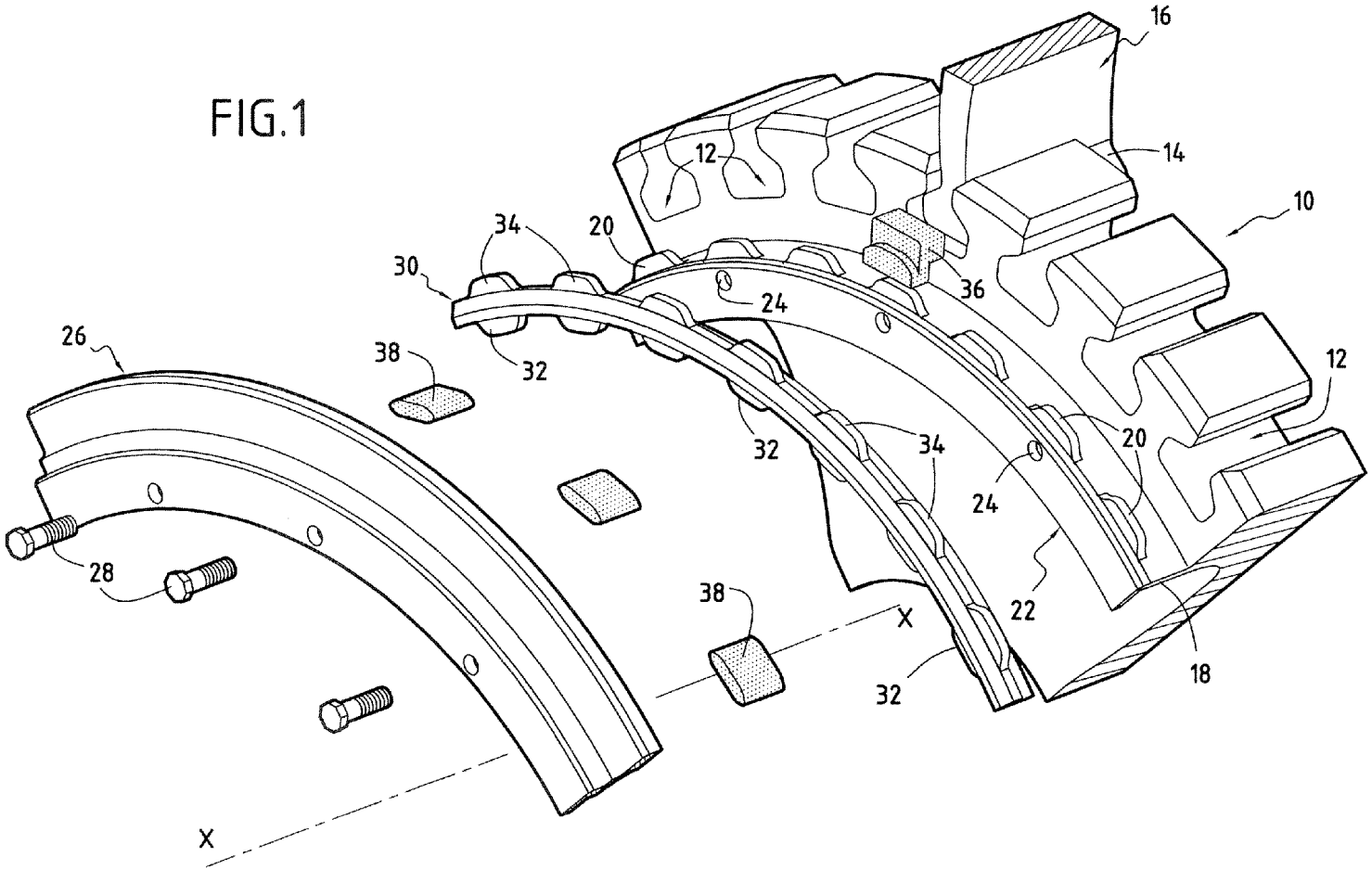
FIG. 1 is a fragmentary perspective and exploded view of a fan disk fitted with a device of the invention for damping vibration.

FIGS. 1 and 2 show a portion of a turbomachine fan disk 10. The disk 10 is suitable for rotating about a longitudinal axis X-X of the turbomachine.

The rotary disk 10 includes a plurality of slots 12 that are regularly distributed around its outer circumference, each slot being designed to receive the root 14 of a fan blade 16 (only one blade is shown in part in FIG. 1). More precisely, the root 14 of each blade 16 is dovetail-shaped and is engaged axially in a corresponding one of the slots 12 that are provided for this purpose.

The rotary disk 10 also has an annular flange 18 extending axially upstream. At its end remote from the disk, the flange 18 is provided with a plurality of outer crenellations (or teeth) 20 which extend radially outwards relative to the disk and which are regularly distributed around the entire circumference of the disk.

It should be observed that the number of outer crenellations 20 on the flange 18 is identical to the number of slots 12 in the disk for receiving the fan blades 16. Furthermore, the outer crenellations 20 are substantially in alignment (in the axial direction) with respective ones of the slots 12.

At its end remote from the disk 10, the flange 18 is also provided with an annular collar 22 extending radially inwards relative to the disk (i.e. towards its axis of rotation X-X). The collar 22 has orifices 24 distributed around its entire circumference. It is desired to receive an annulus 26 that is held thereagainst by means of screws 28 that are received in the orifices 24. The function of such an annulus is to prevent the ring from moving tangentially and to perform other functions within the fan of the turbomachine (in particular to hold the inter-blade platforms).

A retention ring 30 for axially retaining the blades 16 is designed to be mounted around the flange 18 of the disk 10. This retention ring 30 has a plurality of inner crenellations (or teeth) 32 extending radially inwards relative to the disk that are designed to come into contact axially with the outer crenellations 20 of the flange 18 when the ring is mounted around the flange. The number of flange crenellations is thus identical to the number of retention ring crenellations.

Furthermore, the retention ring 30 is provided with outer crenellations (or teeth) 34 that extend radially outwards relative to the disk and that are in radial alignment with the inner crenellations 32 of the ring. When the retention ring 30 is mounted on the flange, these outer crenellations 34 are designed to come into axial abutment against abutment elements 36 mounted to bear against each of the blade roots 14.

Figure 3:
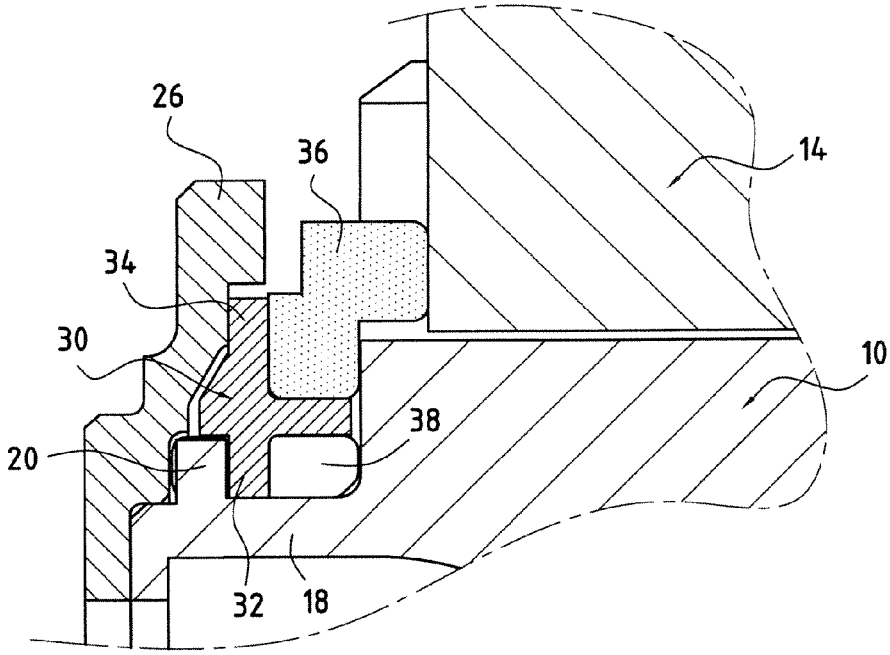
FIGS. 3 and 4 are section views of FIG. 2 respectively on planes III-III and IV-IV.
Figure 4:
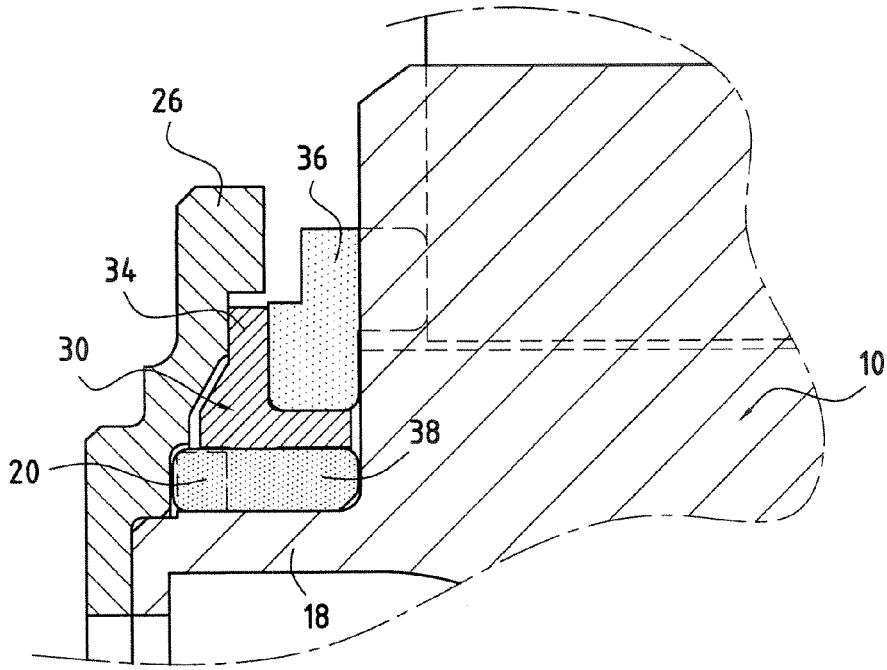

As shown in FIGS. 3 and 4, the retention ring 30 is held axially against on the flange 18 of the disk by contact between its inner crenellations 32 and the outer crenellations 20 of the flange. By means of these outer crenellations 34 which are in axial abutment against the abutment elements 36, the retention ring can thus hold the blade roots 14 axially in their respective slots 12.

The retention ring 30 is mounted on the disk flange 18 as follows: the ring is centered on the longitudinal axis X-X of the turbomachine with its inner crenellations 32 offset axially from the outer crenellations 20 of the disk flange 18. By being moved in axial translation, the ring is brought to surround the flange with each of its inner crenellations 32 being inserted between two adjacent outer crenellations 20 of the flange. Once mounted, the ring is then turned about the longitudinal axis X-X of the turbomachine so that its inner crenellations 32 come into axial contact with the outer crenellations 20 of the flange.

This type of assembly of the fan disk 10 presents certain drawbacks. Firstly, rotation of the disk 10 leads to small movements of the retention ring 30 that cause wear on the tops of the outer crenellations 20 of the disk flange 18. In addition, during rotation of the disk, the retention ring 30 tends to pivot about the disk flange with a risk of the ring becoming disengaged.

In the invention, a device is provided for damping the vibration to which the retention ring 30 is subjected, thereby enabling those drawbacks to be eliminated.

Such a device comprises an abutment element 38 of elastomer material designed to be received firstly axially between two adjacent outer crenellations 20 of the flange 18 on the disk 10 and to complementary adjacent inner crenellations 32 of the retention ring 30, and secondly radially between the flange 18 and the retention ring 30.

Such an abutment element 38, as shown in FIG. 5, is substantially in the form of a flat rectangular block and presents contact surface 40 that are designed to come into contact firstly with the adjacent crenellations 20 and 32 between which it is mounted, and secondly with an inside surface of the retention ring 30 and with the flange 18 of the rotary disk 10.

By the effect of centrifugal force due to the disk 10 rotating, the contact surfaces 40 of the abutment element 38 made of elastomer material deform and press against the retention ring 30 and the disk flange 18, closely matching the outlines thereof. This deformation of the contact surfaces 40 is represented in FIG. 6 by arrows F1.

Adding contact surfaces between the abutment element 38 and the retention ring 30 and the flange 18 of the disk 10 serves to modify the natural modes of vibration of the retention ring. In addition, the contact surfaces 40 of the abutment element 38 deform and therefore damp the vibration to which the retention ring is subject. As a result, any risk of wear is avoided.

By deformation of its contact surfaces 40, the abutment element 38 also serves to provide tangential blocking of the retention ring 30 about the flange 18 of the disk 10, as represented by arrows F2 in FIG. 6.

FIGS. 7A and 7B show various embodiments of the abutment element forming the vibration damper device.

In the example of FIG. 7A, the abutment element 38' of elastomer material is substantially identical to that of FIG. 5, but also has two grooves 42 extending longitudinally in its material. These grooves 42 serve to make it easier to extract the abutment element.

Compared with the embodiment of FIG. 7A, the abutment element 38" of FIG. 7B additionally presents two flats 44 for coming into contact with the inside surface of the retention ring. The particular geometrical shape of this embodiment serves to provide an error-avoidance function to prevent the abutment element being wrongly mounted on the disk; i.e. with this shape the abutment element can be mounted on the disk one way around only.

The elastomer material of the abutment elements 38, 38', and 38" may be a silicone (50D6/50D7, 50D8), a fluorosilicone, or a fluorocarbon, or any other material having equivalent properties.

The elastomer material of the abutment element 38, 38', or 38" preferably presents hardness lying in the range 50 to 90 on the Shore scale.

The number and the angular disposition of the vibration damper devices mounted on the disk may vary. In the example of FIGS. 1 and 2 that show a 90° angular sector of the disk, there are provided three damper devices for seven blades, giving 12 devices for the entire disk which supports a total of 28 blades.

It is nevertheless possible to mount a larger or smaller number of damper devices on the disk. The minimum number is two and the maximum number corresponds to the number of available locations on the disk (i.e. the number of blades supported by the disk). When the number of damper devices is less than the number of blades, these devices need not necessarily be distributed in equidistant manner.

What is claimed is:

1. A device for damping vibration of an axial retention ring for retaining fan blades of a turbomachine, said fan blades being designed to be mounted via their roots on a rotary disk including an annular flange extending axially and provided with a plurality of radial crenellations for coming into contact with a plurality of complementary radial crenellations of the retention ring that is to be mounted around said flange of the disk, said device being made up of an abutment element of elastomer material that is to be received axially between two adjacent crenellations of the flange and two adjacent complementary crenellations of the retention ring, and radially between the flange of the rotary disk and the retention ring, said abutment element presenting contact surfaces for coming into contact with said adjacent crenellations, with the retention ring, and with the flange of the rotary disk.

2. A device according to claim 1, in which the abutment element is substantially in the form of a flat rectangular block.

3. A device according to claim 1, in which the abutment element presents a geometrical shape that is designed to prevent error while it is being mounted on the disk.

4. A device according to claim 1, in which the elastomer material of the abutment element presents hardness lying in the range 50 to 90 on the Shore scale.

5. A device according to claim 1, in which the elastomer material of the abutment element is a silicone, a fluorosilicone, or a fluorocarbon.

6. A rotary disk for a turbomachine for mounting blades of a fan, the disk including an annular flange extending axially and provided with a plurality of radial crenellations for coming into contact with a plurality of complementary radial crenellations of a retention ring for axially retaining fan blades and designed to be mounted around the flange of the disk, the disk including at least two damper devices according to claim 1.

7. A disk according to claim 6, in which the damper devices are equidistant from one another.

8. A retention ring for axially retaining fan blades of a turbomachine, the ring including at least one vibration damper device according to claim 1.

9. A turbomachine including at least one rotary disk according to claim 6.

* * * * *